US009637142B2

(12) United States Patent
Reiling et al.

(10) Patent No.: US 9,637,142 B2
(45) Date of Patent: May 2, 2017

(54) MANWAY GASKET COMPRESSION STOP

(71) Applicant: STRATO, INC., Piscataway, NJ (US)

(72) Inventors: Jason Reiling, Hllsborough, NJ (US); Jennifer Mak, Bridgewater, NJ (US); Michael Serra, Warren, NJ (US)

(73) Assignee: STRATO, INC., Piscataway, NJ (US)

( * ) Notice: Subject to any disclaimer, the term of this patent is extended or adjusted under 35 U.S.C. 154(b) by 141 days.

(21) Appl. No.: 14/730,380

(22) Filed: Jun. 4, 2015

(65) Prior Publication Data

US 2016/0355195 A1 Dec. 8, 2016

(51) Int. Cl.
*B61D 5/00* (2006.01)
*B65D 90/00* (2006.01)

(52) U.S. Cl.
CPC ..... *B61D 5/08* (2013.01)

(58) Field of Classification Search
CPC . B65D 90/10; F16J 13/18; F16J 13/06; Y10T 292/202; Y10T 292/223; Y10T 137/6866; B61D 5/08; B61D 5/00; B60P 3/226; E06B 7/22
USPC ..... 105/377.07, 377.05, 377.11; 220/835; 292/256.5, 256, DIG. 49; 52/20
See application file for complete search history.

(56) References Cited

U.S. PATENT DOCUMENTS

| | | | |
|---|---|---|---|
| 5,622,117 | A | 4/1997 | Burian et al. |
| 5,678,827 | A | 10/1997 | Burian et al. |
| 5,738,396 | A | 4/1998 | Oestermeyer et al. |
| 6,076,471 | A | 6/2000 | Burian et al. |
| 6,390,119 | B1 | 5/2002 | Crochet et al. |
| 6,557,477 | B1 | 5/2003 | Degutis et al. |
| 6,824,140 | B2 | 11/2004 | Frew et al. |
| 6,966,724 | B2 | 11/2005 | Robinson |
| 7,131,455 | B2 | 11/2006 | Horban et al. |
| 8,166,891 | B2 | 5/2012 | Borowski et al. |
| 8,196,523 | B2 | 6/2012 | Blevins, Jr. |
| 8,397,646 | B2 | 3/2013 | Blevins, Jr. |
| 8,499,501 | B2 | 8/2013 | Depietro et al. |
| 8,584,597 | B2 | 11/2013 | Delacerda et al. |
| 8,656,840 | B2 | 2/2014 | Borowski et al. |
| 8,763,850 | B2 | 7/2014 | Depietro |
| 8,784,024 | B2 | 7/2014 | Lison et al. |

(Continued)

FOREIGN PATENT DOCUMENTS

| | | | |
|---|---|---|---|
| GB | 2 088 446 | * | 6/1982 |
| WO | WO 91/01198 | | 2/1991 |

OTHER PUBLICATIONS

Watco Compliance Services, VSP Technologies, and Salco Products, Inc., Guidelines for Hinged and Bolted Manway Assembly, 2013, Renewable Fuels Association , 1-13.

*Primary Examiner* — Mark Le
(74) *Attorney, Agent, or Firm* — Pearl Cohen Zedek Latzer Baratz LLP

(57) ABSTRACT

A system for preventing manway cover gasket over-compression utilizes machined surfaces on the top of eye bolt lugs on the side of a manway nozzle, machined compression stops on the periphery of the cover, and a specified distance between the top of the eye bolt lug and the manway nozzle edge to engage the stops at a predetermined amount of gasket compression. Force is distributed over an increased contact surface area between the manway cover and the bolt lugs to ensure that deformation occurs preferentially in the eye bolts before any other component in the manway cover system.

19 Claims, 4 Drawing Sheets

(56) References Cited

U.S. PATENT DOCUMENTS

| | | | | |
|---|---|---|---|---|
| 8,899,161 | B2 | 12/2014 | Douglas et al. | |
| 2007/0235463 | A1 * | 10/2007 | Wyler ..... | B60P 3/226<br>220/835 |
| 2011/0107940 | A1 | 5/2011 | Borowski et al. | |

* cited by examiner

MANWAY GASKET COMPRESSION STOP

FIELD OF THE INVENTION

The invention relates to a manway cover and nozzle for a railway tank car. Specifically, the invention relates to improvements in the manway cover and nozzle system which prevent over-compression of the manway cover gasket and deformation in the manway cover and/or nozzle.

BACKGROUND OF THE INVENTION

The conventional railway tank car comprises an opening or "manway" on the top for loading, venting or maintenance purposes. The manway includes a sidewall or "nozzle" defining the opening, and a cover received over the nozzle and bolted on. The bolts (sometimes called "eye bolts") are generally attached to the nozzle with respective eye-bolt lugs which attach an end of each respective bolt to the side of the nozzle in a pivoting arrangement. An end of the bolt opposite the lug is received in a slot formed in the periphery of the cover defined between a pair of "ears." A nut and washer bear on the top surface of ears to close the cover and compress the gasket. Association of American Railroads ("AAR") Standard M-1002, which is incorporated by reference, governs manway cover specifications. (Reference to any published standard refers to the standard in effect on the filing date of this application.)

It has been found that excessive torqueing of manway cover bolts may result in gasket deformation, sometimes referred to as "cold flow," resulting in seal failure. Repeated excessive deformation, may reduce gasket life cycle. Over time, over-tightening may cause deformation of the manway cover itself.

Ideally, a manway cover is tightened in stages, with the bolts being tightened manually in a star pattern until a specified assembly torque is reached. Assembly torque may vary, depending on the number of bolts and the gasket material, but a typical specified assembly torque for a six bolt manway cover falls in the range of 80 ft·lb to 120 ft·lb, with a specified maximum of around 200 ft·lb. In practice, however, much greater torques are applied to the bolts, upwards of 400 ft·lb. This is because, in the field, the manway cover bolts may be machine-tightened via impact wrench in a single pass, following a circle pattern, for example. In the case of over-tightening, the pattern of stress on the gasket may be localized around the eye-bolt positions, which leads to gasket failure. In an extreme case, the ears of the manway cover become deformed.

SUMMARY OF THE INVENTION

One object of the invention is to limit gasket overcompression to reduce or eliminate seal failure in a tank car cover.

Another object is to prevent gasket deformation beyond specified limits to improve the life cycle of the gasket.

Still another object of the invention is to prevent cover deformation in the process of tightening manway cover bolts, and more specifically to ensure that the most likely point of deformation is at the eye bolt itself, rather than at the manway cover or nozzle.

Still another object of the invention is to ensure that stress levels in the cover system are not localized around the eyebolts and remain outside the plastic deformation regime at specified maximum loading, thereby reducing the likelihood of failure of a manway cover seal and improving life cycle times of the equipment parts.

These and other objects of the invention are achieved, according to one aspect of the invention, with a manway cover system for a railway tank car comprising: a nozzle having a top edge defining an opening in the tank car, a manway cover received on the nozzle, the cover having a plurality of slots in a peripheral edge thereof for receiving bolts to tighten the manway cover on the nozzle, each of said plurality of slots defined by two ears defining opposite sides of the respective slot. A plurality of bolt lugs is attached on a vertical side surface of the nozzle securing a plurality of respective bolts in a pivoting relationship. A gasket is positioned between the edge of the nozzle and the manway cover. A top surface of each of the plurality of bolt lugs is machined, and a predetermined distance is maintained between the machined top surface of each of the plurality of bolt lugs and the top edge of the nozzle.

At least one projection or "stop" extends downwardly from the peripheral edge of the cover and has a horizontal bottom surface adapted to contact the machined top surface of the bolt lug when the cover is closed on the nozzle. The distance between the horizontal bottom surface of the stop and the machined top surface of the lug may provide for a specified amount of compression of the gasket, such as 25% to 60% of the uncompressed thickness of the gasket, before the stop contacts the top surface of the lug.

In another aspect the invention is a manway cover used in the system, the cover having a projection extending downwardly from each of the ears on the peripheral edge of the cover, and each projection having a machined bottom surface. The machined bottom surfaces of the projections abut the machined top surfaces of respective bolt lugs at a predetermined amount of compression of the gasket.

In still another aspect, the invention is a method of limiting tensile and bending stresses in a manway cover system, comprising machining the top surface of each of said plurality of bolt lugs; machining the bottom surface of each of said projections on the manway cover; and maintaining a predetermined distance between the machined top surface of each of said plurality of bolt lugs and the top edge of the nozzle. Maintaining this predetermined distance within certain tolerances ensures that tightening the bolts to a desired assembly torque causes the machined bottom surface of the projection to abut the machined top surfaces of the bolt lug when the gasket is compressed in a range of 25% to 60%, of its uncompressed thickness. This amount of compression applies to elastomeric gasket materials. In some instances, a gasket material may be thinner, and it may compress without incident to a greater or lesser extent. The design dimension of the compression stop may be adapted in accordance with the thickness of the gasket material and the acceptable amount of deformation, which information is generally readily available from the manufacturer. With the compression stops according to the invention the distribution of stresses on the gasket is more even and is not localized at the eyebolts. Thus, even at specified maximum loading of the eye bolts on the cover, the pressure developed on the gasket at the eye bolt locations is not more than 10% greater than the pressure developed at any other point on the top edge of the nozzle.

The Figures are schematic and not drawn to scale. Some features, not necessary for an understanding of the invention, may be omitted in certain views to better illustrate other features.

DETAILED DESCRIPTION OF THE INVENTION

Directions and orientations herein refer to the normal orientation of a railway car in use. Thus, unless the context clearly requires otherwise, the "longitudinal" axis or direction is parallel to the rails and in the direction of movement of the railway car on the track in any direction, and the manway is on the "top" of the tank car. The "transverse" or "lateral" axis or direction is in a horizontal plane perpendicular to the longitudinal axis and the rail. The term "inboard" means toward the center of the car, and may mean inboard in a longitudinal direction, a lateral direction, or both. Similarly, "outboard" means away from the center of the car. "Horizontal" is a plane parallel to the rails including the transverse and longitudinal axes, and "vertical" is the up-and-down direction. Extending "downward" means toward the ground.

Figure 4:
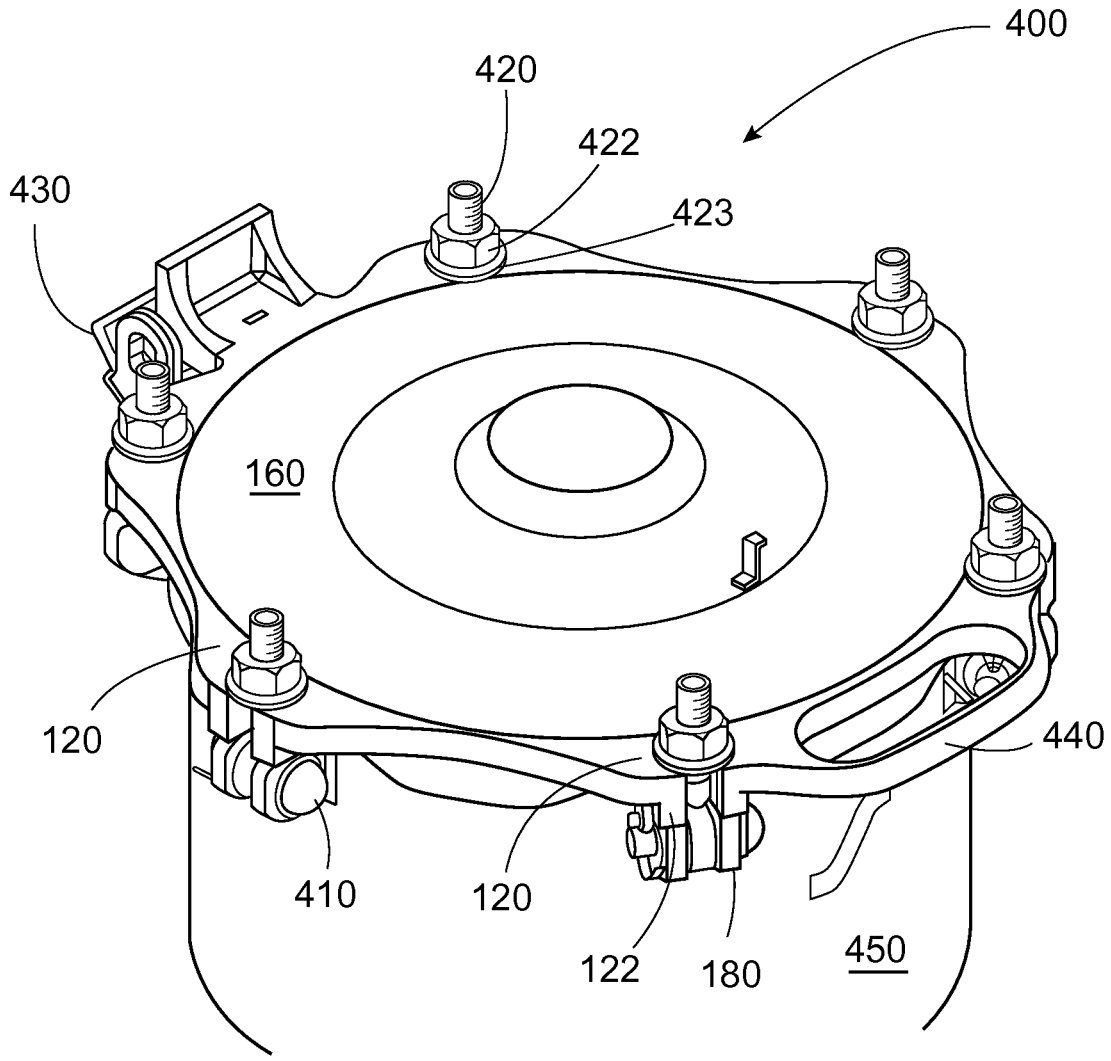
FIG. 4 is a perspective view of a manway nozzle and cover system according to the invention.

FIG. 4 depicts a perspective view of a six-bolt manway nozzle and cover system 400 according to one embodiment of the invention, in which eye bolts 420 are received between ears 120 forming slots on the peripheral edge of the manway cover 160. Conventionally, cover 160 is provided with hinge assembly 430 and handle 440 to facilitate opening. Eyebolts 420 are attached to lugs 180 in a pivoting relationship on the side of nozzle 450 with pin 410. Nuts 422 are tightened over washers 423 to seal cover 160 on nozzle 450.

Figure 1:
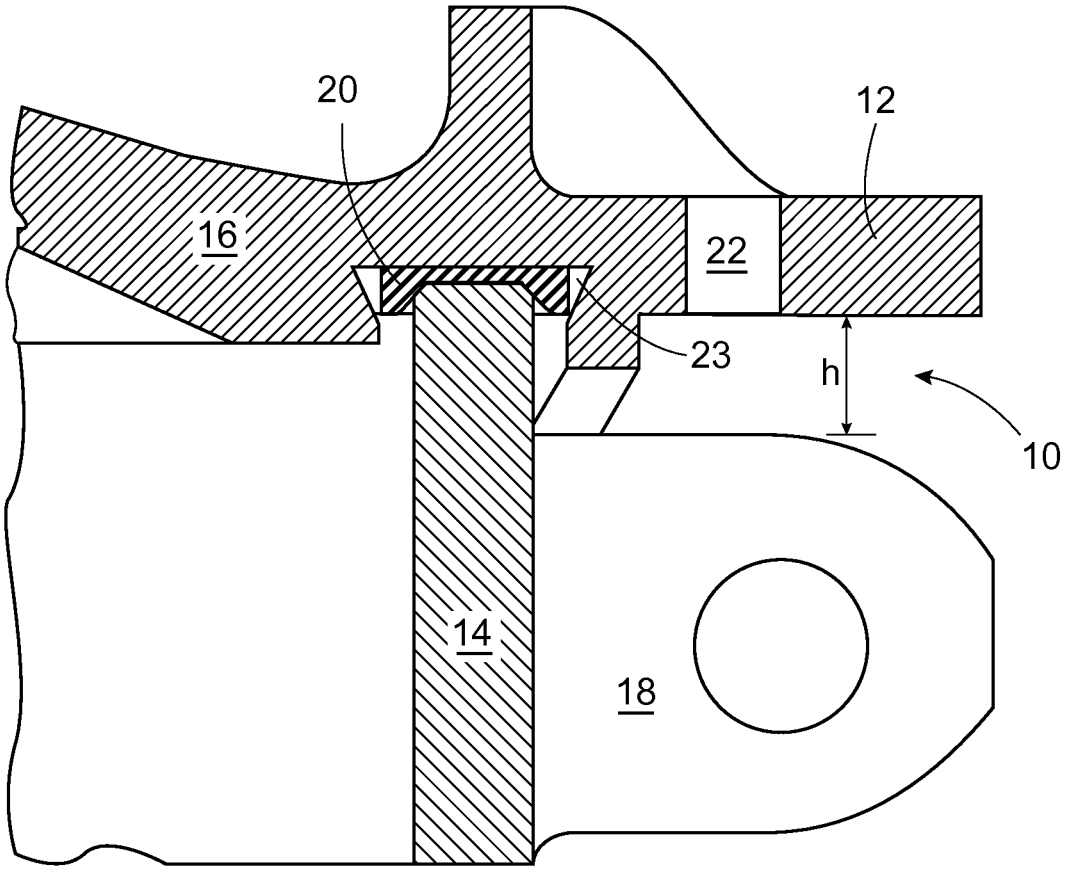
FIG. 1 Prior Art
FIG. 1 depicts a cross sectional detail of a prior art manway cover arrangement at one eye bolt location, showing gasket over-compression.

FIG. 1 depicts a cross section of a manway cover and nozzle system 10, according to the prior art, at one eye bolt. Gasket 20 is received in slot 23 running around the circumference of manway cover 16 as cover 16 is sealed against a top edge of nozzle wall 14. In a conventional manway cover, the distance "h" between the bottom of the manway cover 16, and the top of the lug 18 is arbitrary and depends only on the placement of the lug on the side of the nozzle wall 14. Likewise the distance between the top of the lug 18 and the top of the nozzle wall 14 is not a designed dimension, in that this measurement is not predetermined to impact performance of the gasket and cover system. As a result, gasket 20 is subject to over-compression, particularly around the eye bolt locations. Likewise, the ears 12 of the manway cover 16 are subject to deflection when a bolt received in slot area 22 of the cover is overtightened. Nothing in the conventional system prevents over-compression of the gasket and potential deformation of the cover.

Figure 2:
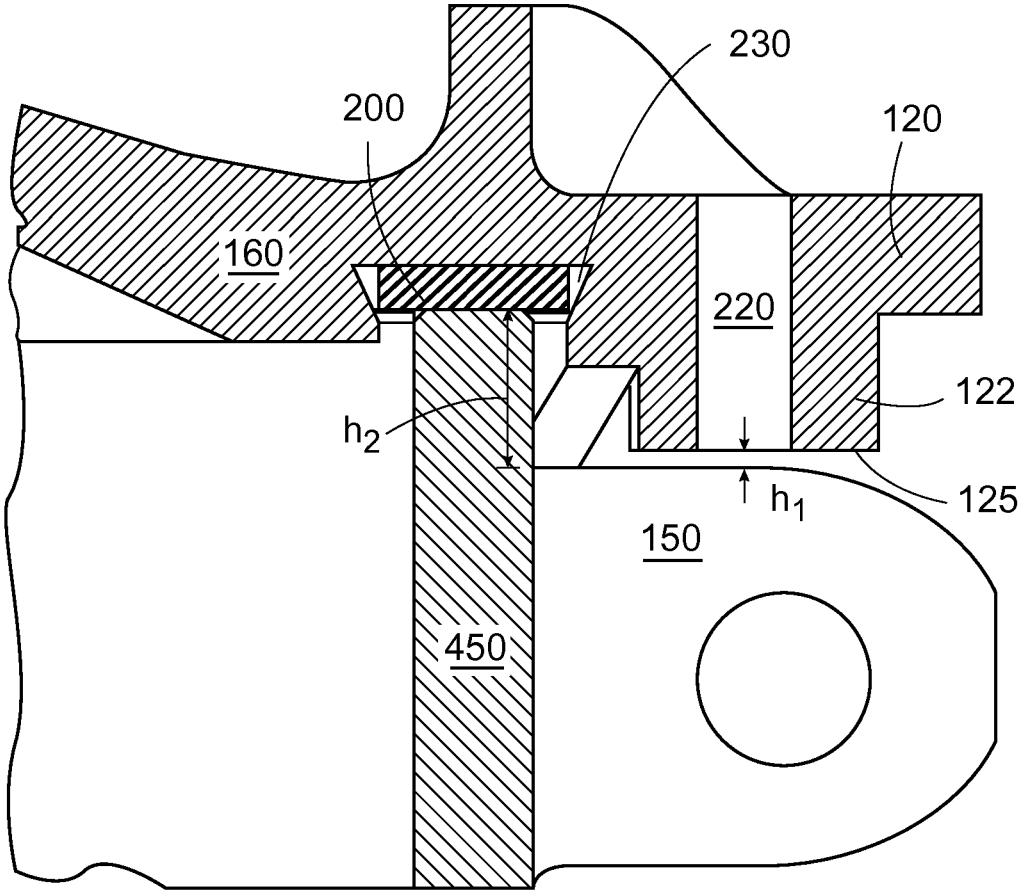
FIG. 2 depicts a cross-sectional detail of a manway cover arrangement according to the invention with the gasket uncompressed.

FIG. 2 depicts a manway nozzle system and gasket stop combination according to the invention prior to tightening the bolts on the cover. The system comprises a plurality of identical lugs (typically 6 or 8 lugs) distributed evenly on the outer side wall 14 of the nozzle, and each lug receives an eye bolt. In the cross section shown, a single lug 150 is depicted, but it is understood that the other lugs are substantially identical to the one described in FIG. 2, including the distances between the top of the respective bolt lug and the top edge of the nozzle, and the cross sectional area of the bolts themselves. The lugs 150 are typically welded onto the nozzle outer wall, but conceivably these might be cast features, or attached by other means known in the art. The bolt includes a horizontal pin attached to the bolt allowing the bolt to rotate about the pin in the bolt lug. In FIG. 2, the pin is not shown and the cross section shows a circular hole in the bolt lug. The top surfaces of the respective lugs 150 are machined to ensure a constant predetermined distance "h2" between the top surface of the lugs and the top edge of the nozzle wall 450. In embodiments, the distance between the top surface of the lugs and the top edge of the nozzle is in a range of 0.7 inch to 1.0 inch, for example 0.8125 inch.

Figure 3:
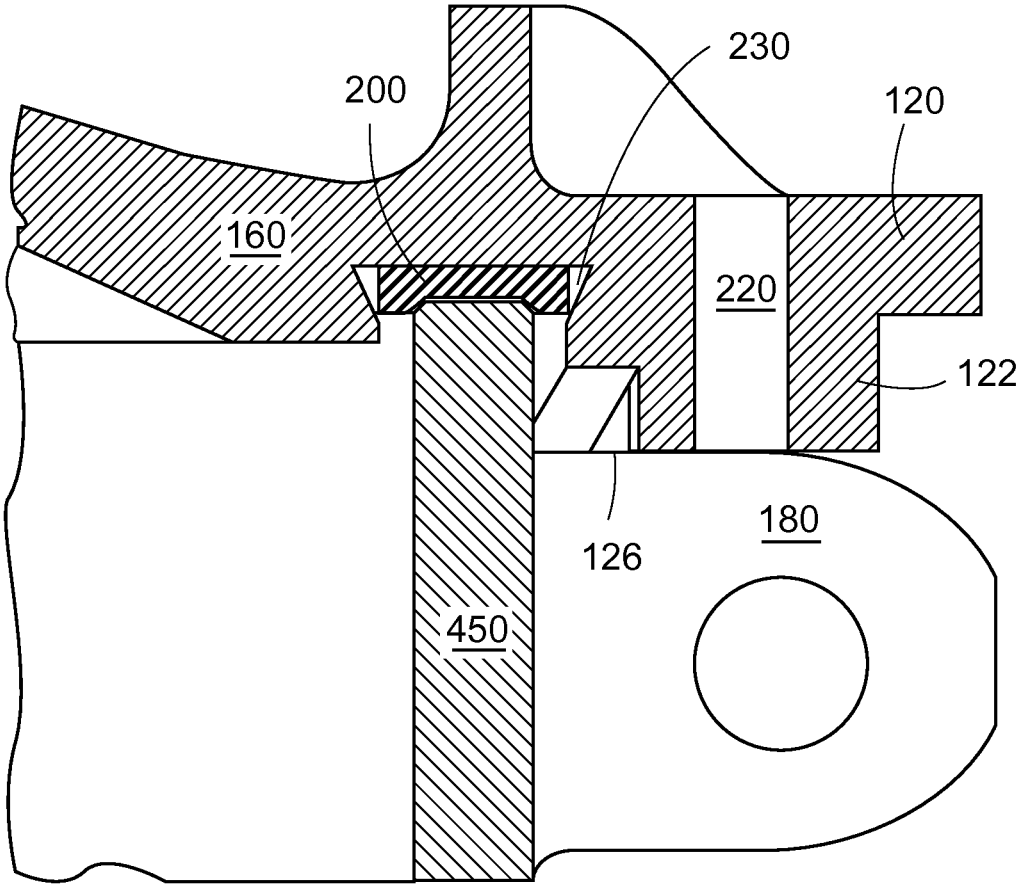
FIG. 3 depicts a cross-sectional detail of a manway cover arrangement according to the invention at designed compression.

Similarly to the prior art, gasket 200 according to the invention is received in circumferential groove 230 in manway cover 160. FIG. 2 depicts an uncompressed gasket 200, while FIG. 3 depicts the gasket 200 after the cover 160 has been closed and the bolts tightened. The system according to the invention may accommodate different types of gasket materials, including elastomeric materials and hard gasket materials. An "elastomeric" material is any material that recovers shape after being deformed, usually a natural or synthetic rubber, including, without limitation, neoprene or n-butyl rubber. In embodiments, elastomeric gaskets according to the invention have an uncompressed thickness in a range of about 0.125 to about 0.375 inches, typically about 0.250 inches which preferably is compressed 25% to 40% in normal usage. A hard gasket material does not recover its original shape when compressed. However, it is still desired in many circumstances to prevent over-compression of a hard gasket. In embodiments, a hard gasket has a thickness of 0.125 inches ±0.005 inches, and may experience compression of about 50% in normal usage, although this might vary depending on the application. As used herein, the "thickness" of the gasket is the thickness of a substantially uncompressed gasket between the contact surface in the manway cover groove 230 and nozzle wall 450, which distance is generally constant around the top edge of nozzle wall 450.

In FIG. 2, gasket 200 is uncompressed and projection 122 extends downwardly from the laterally extending ears 120 so that machined bottom surface 125 is at a distance "h1" from the top surface of the bolt lugs. As shown in FIG. 3, when gasket 200 has been compressed to its designed compression, in embodiments 25 to 40% (or about 0.08 inch for a 0.250 inch rubber gasket), the top surface of bolt lug 150 contacts the bottom surface of the downward projection 122. In this example, "h1" is equal to about 0.08 inch, and after cover 160 has been tightened sufficiently, the bottom surface of the compression stop abuts the top surface of the bolt lug. This contact should occur at a specified assembly torque of 80 ft·lb to 120 ft·lb.

Where the downward projection 122 contacts bolt lug 150 may be referred to as the "contact area." The contact area is preferably greater than the cross sectional area of the bolt received in the slot 220. More preferably, the contact area is increased by a factor of 1.5. In this example, each of the six bolts has a diameter of ⅞ inch, and a cross sectional area (not counting thread profile) of 0.601 sq. in., and the contact area is 1.150 sq. in. The cover 160, including the stop, is generally a cast piece, but it is within the scope of the invention to attach a downward projection to an existing cover as a retrofit, by welding or other means known in the art.

In general, the gasket compression stop 122 is designed to allow the gasket to compress 25 to 60%. However, this is not to be deemed as limiting the invention. Polytetrafluoroethylene (PTFE) gaskets, EPDM rubber (ethylene propylene diene monomer (M-class) rubber) and nitrile (BUNA-N) rubber gaskets are also well known in the art. The thickness of a gasket made out of these materials, and the amount of deformation that the materials can withstand under compression, will vary. An advantage of the present invention is that the amount of compression can be controlled by machining the top of the eyebolt lug to maintain a specified distance between the top of the lug and the top of the nozzle wall. Alternatively, or in addition, the horizontal bottom surfaces on the downward projections 122 on the cover may be machined to achieve a specified clearance h1. Information concerning the elastic properties of gasket materials is readily available from the gasket manufacturers, so that the dimensions of the gasket compression stop can be developed accordingly. An advantage of the cover and nozzle system according to the invention is that dimensions h1 and h2 are design dimensions applicable to different systems to meet performance objectives.

An important aspect of the invention is that increasing the torque on the bolts after the predetermined amount of compression is achieved does not result in a greater stress localized around the eyebolt area. The stress on manway cover components may be evaluated using a pressure film, such as Medium Fuji Film Prescale pressure measurement film, which is a sheet comprising a polyester base layer coated with a color developing material, further layered with micro-encapsulated color forming material on top which breaks in response to pressure, thus reacting with color developing material to display color in proportion to pressure applied. A color chart is used to assess the compression stress developed at each position on the film.

Table 1 depicts the results of testing performed to estimate the pressure on a top surface of a gasket positioned on a manway nozzle during compression of the gasket with increasing torque applied on the bolts and to determine the effectiveness of the compression stops. The reported estimated pressure in this test is the highest pressure (darkest color) developed around the circumference of the nozzle. The uniformity of the pressure developed around the nozzle could also be evaluated by examining the pressure sensitive film. Of particular interest in this test was the pressure developed on the gasket in the location of the eye bolts.

To obtain this data, a pressure film was cut to size and placed over a ¼ inch thick rubber gasket on a manway cover nozzle. In Examples 1-7, according to the invention, a manway cover is provided with compression stops extending downwardly from manway cover ears positioned on opposed sides of each eye bolt. The opposed machined surfaces on the top of the bolt lug and the bottom of the compression stop were 0.08 inch apart before the bolts are tightened. In the Comparative Examples, 8-14, an otherwise identical conventional manway cover was employed for the test. Eye bolts were tightened by hand, using a torque wrench, in increments of 50 ft·lb to reach the maximum torque listed in the Table. Eyebolt tightening was done in both star (recommended) and circular (predicted field expedient) patterns for each load iteration, as noted in Table 1. In all of the Examples and Comparative Examples six eyebolts were used. Example 7 (according to the invention) and Comparative Example 14, bolts were overloaded immediately to 300 ft·lb (i.e., not in increments) to simulate overloading in the field.

Target gasket compression of 30-40% was achieved at just under 100 ft-lbs bolt torque; and compression stops engaged at just under 150 ft-lbs bolt torque. In Example 6, the bolts were all loaded beyond 150 ft·lbs. The consistent intensity pressure lines on the pressure film across the indexed eyebolt location showed that uniform pressure developed around the circumference of the nozzle and that gasket over-compression was prevented when compression stops were used according to the invention. Pressures developed on the gasket leveled off at higher amounts of torque applied to the bolts.

TABLE 1

| | Pattern | Stops | Pass 1 | Pass 2 | Pass 3 | Pass 4 | Max Torque (ft-lb) | Pressure (psi) |
|---|---|---|---|---|---|---|---|---|
| Examples | | | | | | | | |
| Ex 1 | Star | Y | 50 | 100 | N/A | N/A | 100 | 2719.45 |
| Ex 2 | Circle | Y | 50 | 100 | N/A | N/A | 100 | 3589.68 |
| Ex 3 | Star | Y | 50 | 100 | 150 | N/A | 150 | 3589.68 |
| Ex 4 | Circle | Y | 50 | 100 | 150 | N/A | 150 | 2719.45 |
| Ex 5 | Star | Y | 50 | 100 | 150 | 200 | 200 | 3154.57 |
| Ex 6 | Circle | Y | 50 | 100 | 150 | 200 | 200 | 3154.57 |
| Ex 7 | Star | Y | 300 | N/A | N/A | N/A | 300 | 3589.68 |
| Comparative Examples | | | | | | | | |
| C. Ex 8 | Star | N | 50 | 100 | N/A | N/A | 100 | 2719.45 |
| C. Ex 9 | Circle | N | 50 | 100 | N/A | N/A | 100 | 3589.57 |
| C. Ex 10 | Star | N | 50 | 100 | 150 | N/A | 150 | 4351.13 |
| C. Ex 11 | Circle | N | 50 | 100 | 150 | N/A | 150 | 4351.13 |
| C. Ex 12 | Star | N | 50 | 100 | 150 | 200 | 200 | 5076.32 |
| C. Ex 13 | Circle | N | 50 | 100 | 150 | 200 | 200 | 5982.81 |
| C. Ex 14 | Star | N | 300 | N/A | N/A | N/A | 300 | 7179.37 |

Another important aspect of the invention is ensuring that the cover and nozzle components of the system remain safely outside the plastic deformation regime and that the eye bolt is the first element to deform. With the compression stops according to the invention, torque applied to the eye bolts results in pressure distributed over a larger area after the compression stops contact the bolt lugs. Preferably, the contact area between the stops and the bolt lugs should be at least about as large as the cross-sectional area of the bolt itself. The increased contact area ensures that deformation occurs at the eye bolt before other parts.

In order to demonstrate this aspect of the invention, stresses encountered at critical points in the manway cover system may be modeled and analyzed using finite element analysis software, to determine maximum stress and maximum strain at the bolt, the manway cover ears on either side of the bolt, and the nozzle edge. Computer modeling provides an excellent understanding of relative stress and strain encountered at each part of the cover. The person of ordinary skill in the art will appreciate that an understanding of relative stresses and strains may be gained even where the absolute values of the stresses and strains do not exactly match the real world stresses and strains, as a result of limiting assumptions built into the software analysis.

A ratio of maximum stress to yield stress is referred to as a factor of safety (FoS). Comparisons of FoS results from load simulations show the cover and nozzle remaining outside the plastic deformation regime (FoS<1) at 450 ft·lb of torque applied to the bolts when the compression stops according to the invention are used, more than twice the maximum specified assembly torque. The increased area over which pressure is distributed also ensures that the bolt is the first element of the cover system to experience plastic deformation.

In the example of Table 2, finite element analysis software was used to determine the effect of applying torque equally to the eye bolts in a six-bolt cover at 250 ft·lb, 450 ft·lb, and 600 ft·lb, corresponding to axial loads of 26,167 lbf, 36,302 lbf, and 48,403 lbf, respectively, simulating full loading through the contact surfaces of the manway cover, nozzle, and eye-bolt. Bolt torque-force conversions were maximized by calculating with coefficient of friction under ideal lubricated conditions (all friction bearing surfaces).

TABLE 2

| | Max Stress (psi) | Max Strain (in) | Min FoS |
|---|---|---|---|
| Cover | | | |
| 250 ft-lb | 25213 | 0.00109 | 2.022 |
| 450 ft-lb | 45383 | 0.00197 | 1.123 |
| 600 ft-lb | 60511 | 0.0668 | 0.842 |
| Nozzle | | | |
| 250 ft-lb | 24432 | 0.000608 | 2.087 |
| 450 ft-lb | 43977 | 0.0277 | 1.159 |
| 600 ft-lb | 58636 | 0.0371 | 0.869 |
| Bolt | | | |
| 250 ft-lb | 323250 | 0.0067 | 0.12684 |
| 450 ft-lb | 448451 | 0.00929 | 0.0914 |
| 600 ft-lb | 597938 | 0.012 | 0.0685 |

Comparison of Factor of Safety results from simulated loading using a cover according to the invention shows both the cover and nozzle elements remaining safely outside plastic deformation regimes at 200 ft·lb, 250 ft·lb and 450 ft·lb, over twice the specified maximum assembly torques, while the eye-bolts were shown to be the weakest link in the assembly.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

The invention claimed is:

1. A manway cover system for a railway tank car, comprising:

a nozzle having a top edge defining an opening in the tank car;

a manway cover received on the nozzle;

a plurality of bolt lugs on a vertical side surface of the nozzle, each bolt lug having a top surface;

a plurality of slots in a peripheral edge of the manway cover for receiving bolts to tighten the manway cover on the nozzle, each of the plurality of slots defined by two ears defining opposite sides of the respective slot;

at least one projection extending downward from an edge of the manway cover having a horizontal bottom surface adapted to contact the top surface of at least one respective bolt lug;

a plurality of bolts attached to respective bolt lugs in a pivoting relationship; and a gasket received between the nozzle and the manway cover; wherein the top surface of each of said plurality of bolt lugs is at the same distance from the top edge of the nozzle, and wherein contact between the horizontal bottom surface of the projection on the manway cover and the top surface of the at least one bolt lug prevents over-compression of the gasket from tightening the bolts.

2. The manway cover system according to claim 1, comprising projections extending downward from each ear of the manway cover, each projection having a horizontal bottom surface machined to meet a respective machined top surface of a respective bolt lug at a predetermined amount of compression of the gasket.

3. The manway cover system according to claim 1, wherein the gasket has an uncompressed thickness in a range of 0.125 inch to 0.375 inches and the distance between the top surface of each bolt lug and the bottom top edge of the nozzle is in a range of 0.7 inch to 1.0 inch.

4. The manway cover system according to claim 2, wherein a distance from the machined horizontal bottom surface of each projection extending downward from the edge of the manway cover and the machined top surface of each respective bolt lug is 25% to 60% of the uncompressed thickness of the gasket.

5. The manway cover system according to claim 1, wherein the gasket is compressed 25% to 60% when the cover is closed on the nozzle and the bottom surface of the projection extending from the manway cover abuts the top of the bolt lug.

6. The manway cover system according to claim 1, wherein an area on the horizontal bottom surface of each projection extending downwardly from the edge of the manway cover contacting a respective top surface of each respective bolt lug when the cover is closed on the nozzle is at least as large as a cross sectional area of the bolt received in the respective slot.

7. The manway cover system according to claim 1, wherein the cover and nozzle remain outside a plastic deformation regime when a torque of 200 ft·lb is applied to all bolts closing the cover on the nozzle.

8. The manway cover system according to claim 2, wherein an axial pressure developed on the nozzle proximate the bolt lug is no more than 10% greater than a pressure developed at any other point on the top edge of the nozzle.

9. A manway cover for use with a manway cover and nozzle system for a railway tank car, the cover being received on a tank car nozzle defining an opening in the tank car, the cover attached to the nozzle with a plurality of bolts attached to a plurality of respective bolt lugs attached to a vertical sidewall of the nozzle, and a gasket being interposed between a top edge of the nozzle and the cover, the cover comprising:

a circumferential slot in the cover receiving the top edge of the nozzle;

a plurality of slots in a peripheral edge of the cover receiving the bolts to tighten the manway cover on the nozzle, each of said plurality of slots defined by two ears defining opposite sides of the slot; and a projection extending downwardly from the sides of each slot, having a machined horizontal bottom surface, said machined horizontal bottom surface adapted to contact a machined top surface of the bolt lug at a predetermined amount of compression of the gasket.

10. The manway cover according to claim 9, wherein the cover, including the projection extending downwardly from the sides of the slots, is a cast part.

11. The manway cover according to claim 9, wherein the predetermined amount of compression of the gasket is in a range of 25% to 60% of an uncompressed thickness of the gasket.

12. A method for preventing over-compression of a manway cover gasket in a manway cover system for a railway tank car, comprising:

providing a nozzle having a top edge defining an opening in the tank car;

providing a manway cover received on the nozzle with a plurality of slots in a peripheral edge of the cover for receiving bolts to tighten the manway cover on the nozzle, each of the plurality of slots defined by two ears defining opposite sides of the respective slot, and a respective projection extending downwardly from the edge of the cover having a horizontal bottom surface;

providing a plurality of bolt lugs on a vertical side surface of the nozzle, each of said plurality of bolt lugs having a top surface;

providing a plurality of bolts attached to respective bolt lugs in a pivoting relationship;

providing a gasket received between the top edge of the nozzle and the cover;

machining the top surface of each of said plurality of bolt lugs to maintain a constant distance between the machined top surface of each of said plurality of bolt lugs and the top edge of the nozzle; and tightening the manway cover on the nozzle to compress the gasket and contact the horizontal bottom surface of the downwardly extending projection with the machined top surface of the bolt lug, and wherein contact between the horizontal bottom surface of the projection on the manway cover and the top surface of the at least one bolt lug prevents over-compression of the gasket from tightening the bolts.

13. The method of claim 12, comprising machining the horizontal bottom surface of each projection extending downwardly from the edge of the cover to maintain a constant distance between the machined top surface of each of said plurality of bolt lugs.

14. The method according to claim 12, wherein the bolts are tightened to an assembly torque in a range of 80 ft·lb to 120 ft·lb when the top surface of each of said plurality of bolt lugs contacts a horizontal bottom surface of a respective projection on the manway cover.

15. The method according to claim 12, comprising tightening the bolts to compress the gasket between 25% and 60% when the projection extending downward from the cover abuts the top surface of a bolt lug, and wherein further tightening applied to the bolts does not result in further compression of the gasket.

16. The method according to claim 12, wherein a bolt exhibits plastic deformation prior to the nozzle or the cover when increasing load is applied during tightening the manway cover.

17. The method according to claim 12, wherein providing a plurality of bolt lugs comprises welding the plurality of bolt lugs on a vertical side surface of the nozzle.

18. The method according to claim 12, wherein providing a manway cover comprises casting the cover including the projection extending downward from the peripheral edge of the cover as a single piece.

19. The method according to claim 12, wherein an axial pressure developed on the nozzle proximate the bolt lug is no more than 10% greater than a pressure developed at any other point on the top edge of the nozzle.

* * * * *